US006289789B1

(12) United States Patent
Heeb et al.

(10) Patent No.: US 6,289,789 B1
(45) Date of Patent: Sep. 18, 2001

(54) EXPLOSIVE POWDER CHARGE-OPERATED SETTING TOOL

(75) Inventors: Norbert Heeb, Buchs (CH); Markus Sprenger, Eschen (LI); Sybille Renner, Grabs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/470,011

(22) Filed: Dec. 22, 1999

(30) Foreign Application Priority Data

Dec. 24, 1998 (DE) ..... 198 60 194

(51) Int. Cl.[7] ..... F01B 11/02

(52) U.S. Cl. ..... 92/169.1; 60/632; 227/9; 227/10

(58) Field of Search ..... 92/169.1; 60/632, 60/637, 638; 227/9, 10, 11; 102/530, 531

(56) References Cited

U.S. PATENT DOCUMENTS 6,059,162 * 5/2000 Popovich et al. ..... 227/10

FOREIGN PATENT DOCUMENTS 1502154 6/1969 (DE) .
1806568 5/1970 (DE) .
1355370 2/1964 (FR) .

* cited by examiner

*Primary Examiner*—Edward K. Look
*Assistant Examiner*—Thomas E. Lazo
(74) *Attorney, Agent, or Firm*—Sidley Austin Brown & Wood, LLP

(57) ABSTRACT

An explosive powder charge-operated setting tool, including a guide cylinder (1), a drive piston (6) displaceably supported in the guide cylinder bore (2), a carrier (3) having in its end region facing in a direction opposite to the setting direction, a catridge-receiving chamber (10) and a first active surface (4) facing in the setting direction and from which a cylindrical projection (11) extends with an end surface of the cylindrical projection (11) facing in the setting direction forming a second active surface (5), with the first active surface (4) of the carrier (3) cooperating with a stop surface (13) provided on the drive piston, with the drive piston (6) having a cylindrical recess (12) extending from the stop surface (13) for receiving the projection, and with the tool further including a connection channel connecting the second and first active surfaces.

5 Claims, 1 Drawing Sheet

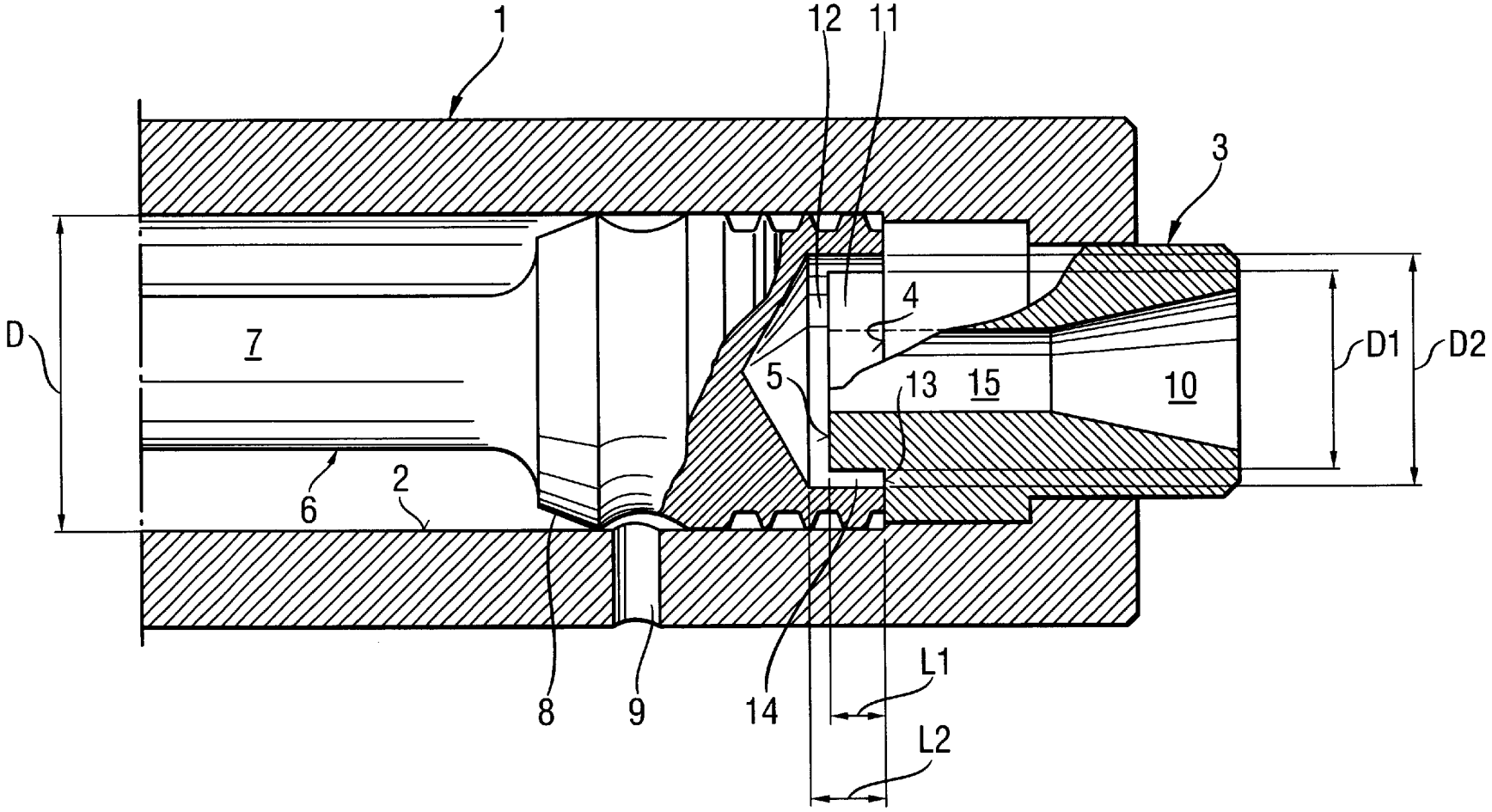
D2
D1
3
10
15
13
4
11
12
5
L1
L2
14
9
8
1
2
6
7
D

EXPLOSIVE POWDER CHARGE-OPERATED SETTING TOOL

BACKGROUND OF THE INVENTION

1. Field of the Invention

The present invention relates to an explosive powder-charge operated setting tool including a guide cylinder having a bore, a drive piston displaceably supported in the bore of the guide cylinder and having a stop surface facing in a direction opposite to setting direction, a carrier having, in its end region facing in a direction opposite to the setting direction, a catridge-receiving chamber and a first active surface facing in the setting direction and from which a cylindrical projection extends, with an end surface of the cylindrical projection facing in the setting direction forming a second active surface, and with the stop surface of the drive piston cooperating with the active surface of the support, with the drive piston having a cylindrical recess extending from the stop surface in the setting direction and in which the cylindrical projection of the carrier is received.

2. Description of the Prior Art

For driving fastening elements in hard constructional components, such as concrete, rock, or steel, setting tool, which are driven by propellant means—containing catridges, are used. One of such setting tool is disclosed in French patent No. 1,355,370. The setting tool disclosed in the French patent has a drive piston displaceable in a guide cylinder, and a carrier having a catridge-receiving chamber.

The drive piston is supported in the running bore of the guide cylinder with a possibility of displacement relative to the guide cylinder. The carrier is provided in an end of the guide cylinder facing in a direction opposite to the setting direction and is connected with the guide cylinder. The carrier has a first active surface which is formed by an end surface of the carrier facing in the setting direction and a catridge-receiving chamber formed in an end of the carrier facing in a direction opposite to the setting direction. A central cylindrical projection extends from the first active surface in the setting direction. The cylindrical projection is provided with a second active surface likewise facing in the setting direction. The carrier further includes a connection bore which connects the catridge-receiving chamber with the bore of the guide cylinder.

The drive piston has, in its end facing in the direction opposite to the setting direction, a recess opening in the direction opposite to the setting direction. The inner diameter of this recess substantially corresponds to the outer diameter of the cylindrical projection of the carrier. Because of this, upon ignition of a catridge, a high initial acceleration is sharply reduced to a much smaller acceleration as soon as the projection leaves the recess in the drive piston in which it is received. This sharp transition from a high acceleration to a low acceleration results in a sharp pressure drop in the combustion chamber which, in turn, results in incomplete combustion of the propellant means. The incomplete combustion of the propellant means leads to an excessive soiling of the setting tool.

Accordingly, an object of the present invention is to provide an explosive powder charge-operated setting tool in which complete combustion of the propellant means takes place after the initial high acceleration following the ignition of the catridge.

Another object of the present invention is to provide an explosive powder charge-operated setting tool in which a uniform transition from the initial high acceleration to the smaller acceleration takes place, so that no sharp pressure drop occurs in the combustion chamber.

SUMMARY OF THE INVENTION

These and other objects of the present invention, which will become apparent hereinafter, are achieved by providing a connection channel which connects the second active surface with the first active surface.

The connection channel according to the present invention insures that immediately before the acceleration of the drive piston in the setting direction or shortly after the start of the acceleration, a portion of the propellant gas, which is generated upon the ignition of the catridge, is diverted to the first active surface of the carrier. Thus, with an increased displacement of the drive piston in the setting direction, the propellant gas and, thereby, the pressure produced by the propellant gas acts on the first active surface. Therefore, the pressure in the recess of the drive piston drops slowly as soon as the projection leaves the recess.

From the manufacturing point of view, it is advantageous when the connection channel extends at least partially over the circumference of the cylindrical projection and along the entire length of the projection.

In order to provide a uniform distribution of the pressure, which is generated by the propellant gas, over the entire surface of the first active surface, advantageously, the connection channel is formed by an annular gap between the outer contour of the cylindrical projection and the inner contour of the cylindrical recess in which the projection is received.

A particularly good and complete combustion of the powder propellant means is achieved when the cross-section of the connection channel amounts to from about 0.04 to about 0.5 of the difference between the cross-sections of the first and second active surfaces.

In order to achieve, before the start of displacement of the drive piston, a good propagation of the propellant gas pressure, which is generated upon the ignition of the catridge, between the second active surface and the recess bottom, preferably, the length of the projecting is selected so that it corresponds to from about 0.5 to about 0.9 of the depth of the recess.

The novel features of the present invention, which are considered as characteristic for the invention, are set forth in particular in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

Single FIGURE of the drawings shows a partial cross-sectional view of an explosive power charge-operated setting tool according to the present invention.

DETAILED DESCRIPTION OF THE PREFERRED EMBODIMENT

The drawing FIGURE shows a guide cylinder 1 which forms a part of an explosive powder charge-operated setting tool, not shown in detail. The cylinder 1 has a central bore 2 in which a drive piston 6 is displaceably supported. The guide cylinder 1 itself is arranged in the setting tool housing, not shown, for displacement parallel to the setting direction. The guide cylinder 1 has a discharge channel 9 which communicates the bore 2 with atmosphere.

A carrier 3, which is connected with the guide cylinder 1, projects into the end region of the guide cylinder 1 facing in a direction opposite to the setting direction. The carrier 3 has a catridge-receiving chamber 10 which widens in the direction opposite to the setting direction. A centrally arranged cylindrical projection 11, which has a predetermined diameter D1, projects from a first active surface 4, which faces in the setting direction, toward the second active surface 5. A mouth of a connection bore (15), which connects the catridge-receiving chamber 10 with the central bore 2 of the guide cylinder 1, lies in the active surface 5.

The drive piston 6 has a head 8 and a shaft 7 which adjoins the head 8 and extends in the setting direction. The shaft 7 has a diameter which is smaller than the diameter of the head 8 which corresponds substantially to the diameter of the bore 2 of the guide cylinder 1. A cylindrical recess 12 extends in the setting direction in the head 8, starting from the free end of the drive piston 7 facing in the direction opposite to the setting direction. The end surface of this free end serves as a stop surface 13. The projection 11 of the carrier 3 projects into the recess 12 formed in the head 8 of the drive piston 6. The length L1 of the cylindrical projection 11, which is measured parallel to the setting direction, corresponds to from about 0.5 to about 0.9 of the depth L2 of the recess 12. A tapering bottom region of the drive piston 6, which extends in a setting direction, adjoins the recess 12 and ends in a peak.

A connection channel 14, which is formed as an annular gap between the outer contour of the projection 11 of the support 3 and the inner contour of the recess 12, extends from the second active surface 5 toward the first active surface 4.

Though the present invention has been shown and described with reference to a preferred embodiment, such is merely illustrative of the present invention and is not to be construed as a limitation thereof, and the present invention includes all modifications, variations and/or alternate embodiments within the spirit and scope of the present invention as defined by the appended claims.

What is claimed is:

1. An explosive powder charge-operated setting tool, comprising a guide cylinder (1) having a bore (2); a drive piston (6) displaceably supported in the bore (2) of the guide cylinder (1) and having a stop surface (13) facing in a direction opposite to setting direction; a carrier (3) having, in an end region thereof facing in a direction opposite to the setting direction, a catridge-receiving chamber (10) and a first active surface (4) facing in the setting direction and from which a cylindrical projection (11) extends, an end surface of the cylindrical projection (11) facing in the setting direction forming a second active surface (5), the stop surface (13) of the drive piston (6) cooperating with the active surface (4) of the carrier (3), the drive piston (6) having a cylindrical recess (12) extending from the stop surface (13) for receiving the projection (11); and a connection channel (14) connecting the second active surface (5) with the first active surface (4).

2. A setting tool according to claim 1, wherein the connection channel (14) extends at least partially over a circumference of the cylindrical projection (11) and over an entire length (L1) of the cylindrical projection (11).

3. A setting tool according to claim 1, wherein the connection channel (14) is formed by an annular gap between an outer contour of the cylindrical projection (11) and an inner contour of the cylindrical recess (12).

4. A setting tool according to claim 3, wherein a cross-sectional surface of the connection channel (14) corresponds to from about 0.04 to about 0.5 of a cross-sectional surface defined by a difference of cross-sectional surfaces of the first and second active surfaces (4 and 5).

5. A setting tool as set forth in claim 1, wherein the cylindrical projection (11) has a length (L1) corresponding to from about 0.5 to about 0.9 of a depth (L2) of the cylindrical recess (12).

* * * * *